US009624006B2

(12) United States Patent
Savino

(10) Patent No.: US 9,624,006 B2
(45) Date of Patent: Apr. 18, 2017

(54) UNIVERSAL NON-SPILL BOTTLE CAP

(71) Applicant: Nadine Savino, Staten Island, NY (US)

(72) Inventor: Nadine Savino, Staten Island, NY (US)

( * ) Notice: Subject to any disclaimer, the term of this patent is extended or adjusted under 35 U.S.C. 154(b) by 0 days.

(21) Appl. No.: 14/976,299

(22) Filed: Dec. 21, 2015

(65) Prior Publication Data

US 2016/0272377 A1 Sep. 22, 2016

Related U.S. Application Data

(60) Provisional application No. 62/134,343, filed on Mar. 17, 2015.

(51) Int. Cl.

*B65D 41/16* (2006.01)
*B65D 41/04* (2006.01)
*B65D 39/02* (2006.01)

(52) U.S. Cl.

CPC ..... *B65D 41/16* (2013.01); *B65D 39/025* (2013.01); *B65D 41/04* (2013.01); *B65D 2231/022* (2013.01)

(58) Field of Classification Search

CPC B65D 41/16; B65D 41/0421; B65D 41/0471; B65D 41/04; B65D 39/02; B65D 39/025; B65D 39/04; A47G 19/2266; A47G 19/2272; A47G 21/18

USPC ..... 215/319, 316, 229, 228, 329, 344, 343, 215/341, 349, 363, 364; 220/287, 709, 220/707, 705, 293, 288, 803, 802, 801

See application file for complete search history.

(56) References Cited

U.S. PATENT DOCUMENTS 1,686,238 A * 10/1928 Julius ..... B65D 39/04 215/273
2,052,496 A * 8/1936 Stassi ..... A47G 19/2266 215/229
2,129,406 A * 9/1938 Cole ..... B65D 39/04 215/354
2,396,337 A * 3/1946 Moore ..... B65D 39/04 215/270
3,167,210 A * 1/1965 Carney, Jr. ..... B65D 39/086 220/258.3
3,392,859 A * 7/1968 Fischer ..... B65D 51/002 215/247
4,164,304 A * 8/1979 Roberson ..... B65D 39/084 220/214
4,247,016 A * 1/1981 Shaw ..... A47G 21/18 220/708
5,211,298 A * 5/1993 Bloch ..... A47G 19/2266 215/11.1
6,363,979 B1 * 4/2002 Chafin ..... B65D 47/061 141/114
2006/0086758 A1 * 4/2006 Coles ..... A45F 3/16 222/211

(Continued)

*Primary Examiner* — Robert J Hicks

(74) *Attorney, Agent, or Firm* — Carter, DeLuca, Farrell & Schmidt, LLP

(57) ABSTRACT

A universal non-spill cap includes an outer wall, an inner wall, and a disk. The outer wall has a bottom end and a top end. The inner wall extends from the top end of the outer wall to the disk. The inner wall defines a gap with the outer wall that is configured to receive a neck of a bottle such that the outer wall forms a seal with the inner wall. The disk is supported by the inner wall. The disk defines an opening that is configured to receive and form a seal about a drinking implement that is inserted through the opening.

15 Claims, 5 Drawing Sheets

(56) References Cited

U.S. PATENT DOCUMENTS

| | | | | |
|---|---|---|---|---|
| 2012/0205389 | A1* | 8/2012 | Beary | A47G 19/2222<br>220/708 |
| 2015/0102029 | A1* | 4/2015 | Bargiel | A47G 19/2272<br>220/23.89 |

* cited by examiner

UNIVERSAL NON-SPILL BOTTLE CAP

CROSS-REFERENCE TO RELATED APPLICATION

This application claims the benefit of, and priority to, U.S. Provisional Patent Application Ser. No. 62/134,343, filed on Mar. 17, 2015, the entire contents of which are hereby incorporated by reference.

BACKGROUND

1. Technical Field

The present disclosure relates to caps for drinking containers and, more specifically, to universal non-spill caps for bottles.

2. Discussion of Related Art

When a typical beverage bottle/container is opened/uncapped, it is common place for individuals to insert a straw into the open bottle to drink the contents of the bottle without directly contacting the bottle. However, spillage can easily occur if the bottle is moved, tips over, or falls on its side while the bottle is uncapped.

Current non-spill drink devices and systems prevent spillage while also permitting the contents of the bottle to be consumed. However, these non-spill drink systems generally require the contents of a bottle to be removed from the original bottle and poured into a proprietary container. A proprietary lid is then placed on the proprietary container to prevent spillage while permitting the contents of the non-spill drink system to be consumed. By requiring the contents of the original bottle to be poured into a proprietary container, typical drink systems require additional containers to be carried which may be cumbersome. In addition, the proprietary containers and lids require additional cleaning and additional steps to be used (e.g., pouring the contents to be consumed from the original bottle into the propriety container.

There is a need for a non-spill cap that can be used with typical beverage bottles. In addition, there is a need for a non-spill cap that allows the passage of a typical straw into the contents of the bottle to permit consumption through the straw while preventing spillage.

SUMMARY

The present disclosure relates generally to a universal non-spill cap that can be placed over a mouth of a beverage bottle to seal the bottle while permitting a straw to be inserted through an opening defined by the non-spill cap to be used to consume the contents of the bottle. The non-spill cap may be stretchable to fit a variety of beverage bottles. Further, the opening may be sized to seal the mouth of the bottle in the absence of a straw and to form a seal with an outer surface of a straw when the straw is inserted through the opening. Such a non-spill cap would allow the consumption of the contents of beverage bottles without requiring propriety containers and lids.

In an aspect of the present disclosure, a universal non-spill cap includes an outer wall, an inner wall, and a disk. The outer wall has a bottom end and a top end. The inner wall extends from the top end of the outer wall to the disk. The inner wall defines a gap with the outer wall that is configured to receive a neck of a bottle such that the outer wall forms a seal with the inner wall. The disk is supported by the inner wall. The disk defines an opening that is configured to receive and form a seal about a drinking implement that is inserted through the opening.

In aspects, the outer wall includes engagement features that extend towards the inner wall. The engagement features are configured to engage an outer surface of the neck of the bottle to secure the non-spill cap to the neck of the bottle. The engagement features may be threads or annular rings.

In some aspects, the opening is defined at the center of the disk. The opening may be a circular opening or include first and second slits that intersect to form a cross. The opening may be configured to seal a mouth of the bottle.

In another aspect of the present disclosure, a method of consuming contents of a beverage bottle is described. The method includes covering a mouth of a bottle with a non-spill cap, inserting a drinking implement through an opening defined in a disk of the cap, and consuming the contents of the bottle through the drinking implement. Covering the mouth of the bottle with the non-spill cap includes positioning the disk within the mouth of the bottle and stretching an outer wall of the non-spill cap around an outer surface of a neck of the bottle.

In aspects, the method includes removing a cover from over the mouth of the bottle before covering the mouth of the bottle with the non-spill cap. Covering the mouth of the bottle with the non-spill cap may seal the mouth of the bottle. Stretching the outer wall of the non-spill cap around an outer surface of the neck of the bottle includes engaging the outer surface of the neck of the bottle with engagement features extending from the outer wall towards an inner wall of the non-spill cap. Engaging the outer surface of the neck of the bottle may include threading the engagement features of the outer wall into threads on the outer surface of the neck of the bottle.

Further, to the extent consistent, any of the aspects described herein may be used in conjunction with any or all of the other aspects described herein.

BRIEF DESCRIPTION OF THE DRAWINGS

Various aspects of the present disclosure are described hereinbelow with reference to the drawings, which are incorporated in and constitute a part of this specification, wherein.

DETAILED DESCRIPTION

Figure 1:
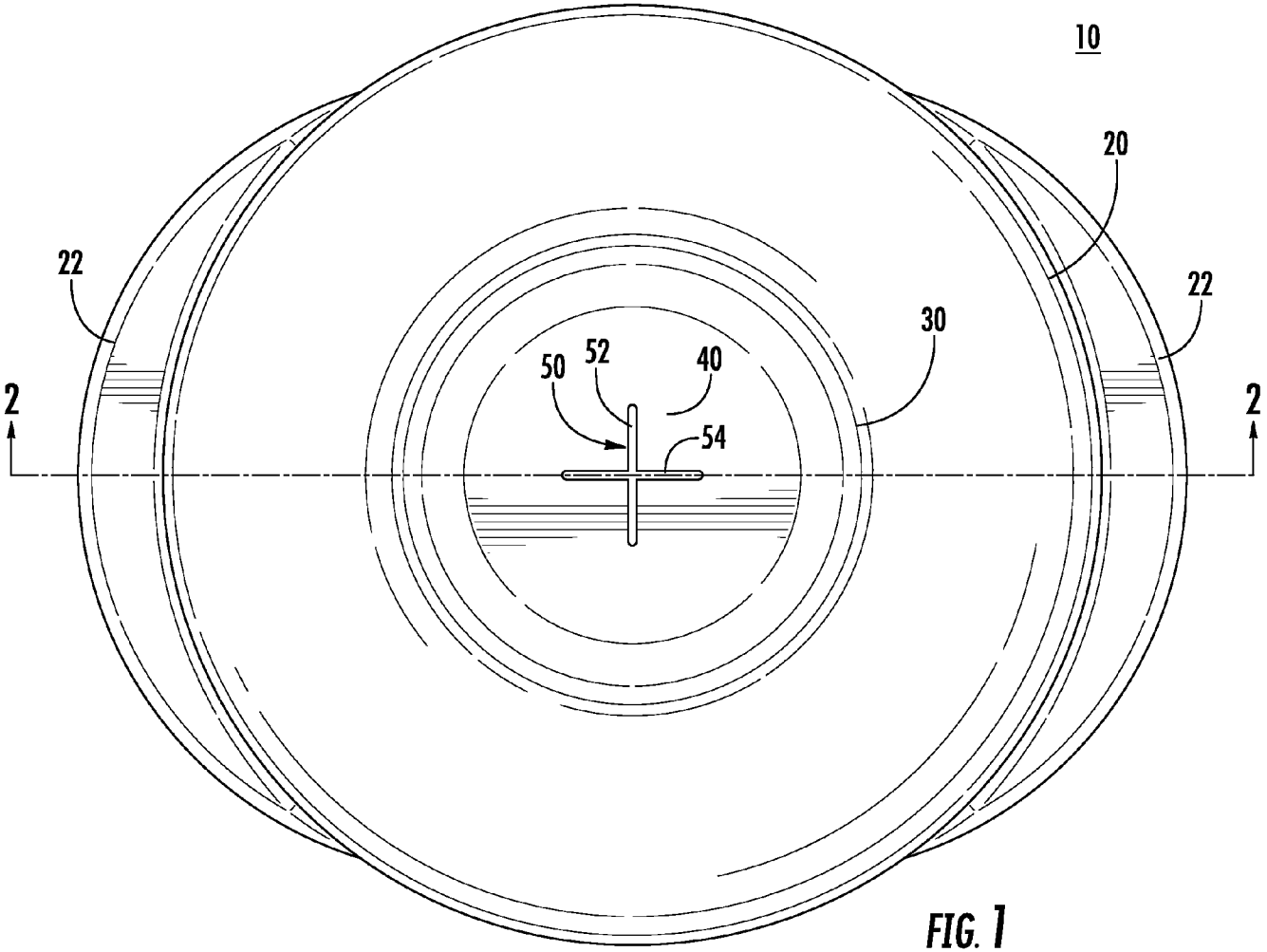
FIG. 1 is a top view of a universal non-spill cap provided in accordance with the present disclosure.

Embodiments of the present disclosure are now described in detail with reference to the drawings in which like reference numerals designate identical or corresponding elements in each of the several views. Throughout this description, the term "proximal" refers to the portion of the device or component thereof that is closest to the user and the term "distal" refers to the portion of the device or component thereof that is farthest from the user.

Figure 2:
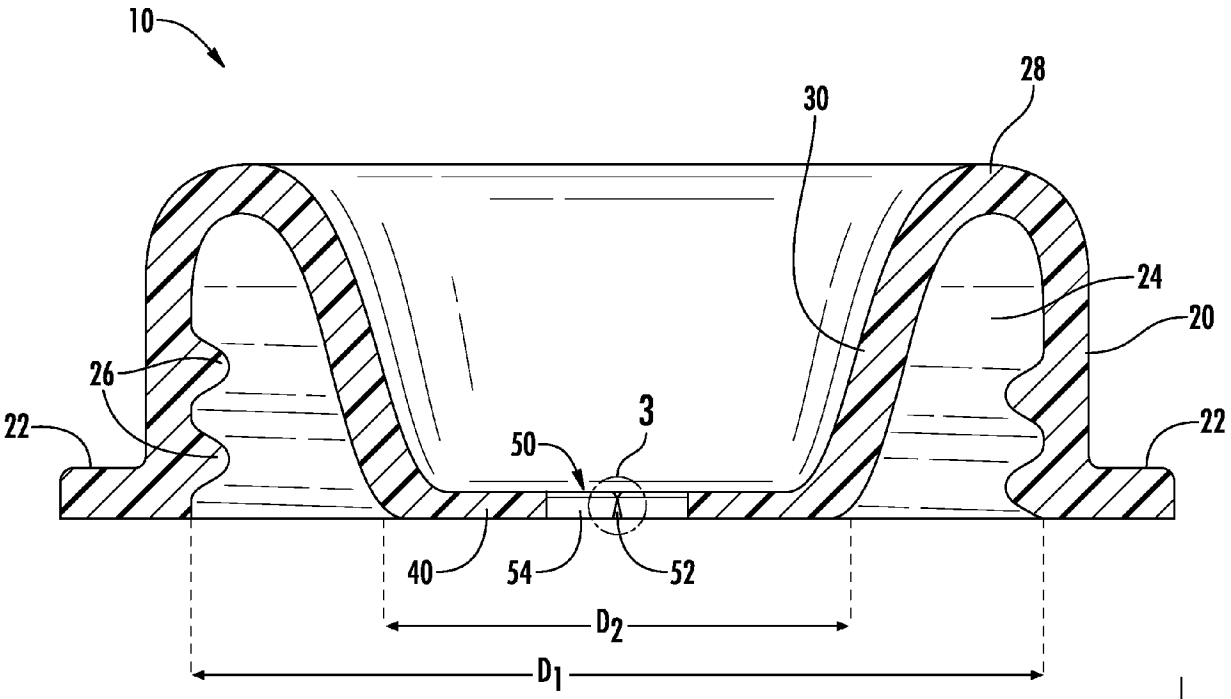
FIG. 2 is a cross-sectional view taken along section line 2-2 of FIG. 1.

Referring to FIGS. 1 and 2, a universal non-spill cap 10 is provided in accordance with the present disclosure and includes an outer wall 20, an inner wall 30, and a recessed disk 40. The outer wall 20 defines a substantially cylindrical shape of the non-spill cap 10. With particular reference to FIG. 2, the outer wall 20 also defines a gap 24 between an inner surface of the outer wall 20 and the inner wall 30. The outer wall 20 may include engagement features 26 that extend from the outer wall 20 towards the inner wall 30. The engagement features 26 may be in the form of circumferential rings, threads, or other known features to engage the threads 112 (FIG. 5) of a bottle 100 as detailed below to secure the non-spill cap 10 to a neck 110 of the bottle 100. The inner dimension of the outer wall 20 defines a dimension $D_1$ which is sized to be slightly smaller than the outer surface of the neck 110 of the bottle 100 when in an unexpanded condition as detailed below.

The outer wall 20 may include release flanges 22 that extend outward from a bottom of the outer wall 20 to aid in removal of the non-spill cap 10 from a bottle as detailed below. The release flanges 22 extend from the outer wall 20 to form an elliptical shape when viewed from the top of the non-spill cap 10 as shown in FIG. 1.

The top of the outer wall 20 is connected to the inner wall 30 by an upper ring 28. The inner wall 30 tapers inward from the upper ring 28 to the recessed disk 40 such that the inner wall 30 forms a frustoconical shape. The outer dimension of the inner wall 30 adjacent the recessed disk 40 defines a dimension $D_2$ which is smaller than the dimension $D_1$. The dimension $D_2$ is sized to allow the recessed disk 40 to fit within the neck 110 (FIG. 5) of the bottle 100 as detailed below.

Continuing to refer to FIGS. 1 and 2, the recessed disk 40 is planar and is positioned substantially parallel with the bottom of the outer wall 20. The recessed disk 40 may also be positioned above or below a plane defined by the bottom of the outer wall 20. The recessed disk 40 defines an opening 50 that allows a drinking implement 60 (FIG. 4) to pass through the recessed disk 40 while forming a seal about the drinking implement 60 to prevent spillage through the opening 50 before and after the drinking implement 60 is inserted through the opening 50. As shown, the opening 50 includes a first slit 52 and a second slit 54 that are perpendicular to one another to form a cross with an intersection located substantially at the center of the recessed disk 40. Each slit 52, 54 is large enough to permit the drinking implement 60 to be inserted through the opening 50 and small enough to prevent liquid from passing through the opening 50. It will be appreciated that the slits 52, 54 are small enough such that surface tension of typical beverages (e.g., water, soda, sports drinks, juices, etc.) prevent the beverages from passing through the slits 52, 54. As shown in FIGS. 1-5, the opening 50 is formed by intersecting slits 52, 54, however, as shown in FIG. 6, the opening 50' may be a circular opening with a diameter smaller than a drinking implement such that the drinking implement 60 stretches the opening 50 when inserted therethrough to form a seal about the drinking implement 60.

Figure 3:
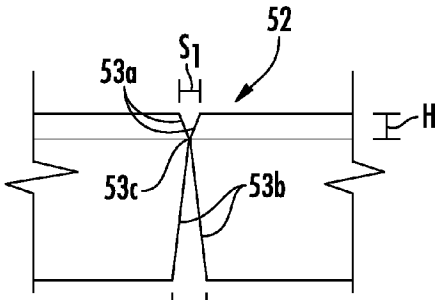
FIG. 3 is an enlarged view of the indicated area of detail of FIG. 2.

Referring to FIG. 3, the slit 52 may be formed from upper angled walls 53*a* and lower angled walls 53*b*. The upper and lower angled walls 53*a*, 53*b* may intersect at a vertex 53*c* that is spaced a height H from an upper surface of the recessed disk 40. The height H may be in a range of about 0.015 inches to about 0.021 inches (e.g., 0.019 inches). The upper angled walls 53*a* are spaced apart a first distance $S_1$ at an upper surface of the recessed disk 40 and the lower angled walls 53 are spaced apart a second distance $S_2$ at a lower surface of the recessed disk 40. The first distance $S_1$ is less than the second distance $S_2$ and is in a range of about 0.007 inches to about 0.009 inches (e.g., about 0.008 inches). The second distance $S_2$ is in a range of about 0.018 inches to about 0.026 inches (e.g., about 0.022 inches). The slit 54 is substantially similar to the slit 52 and will not be detailed herein for reasons of brevity.

Figure 4:
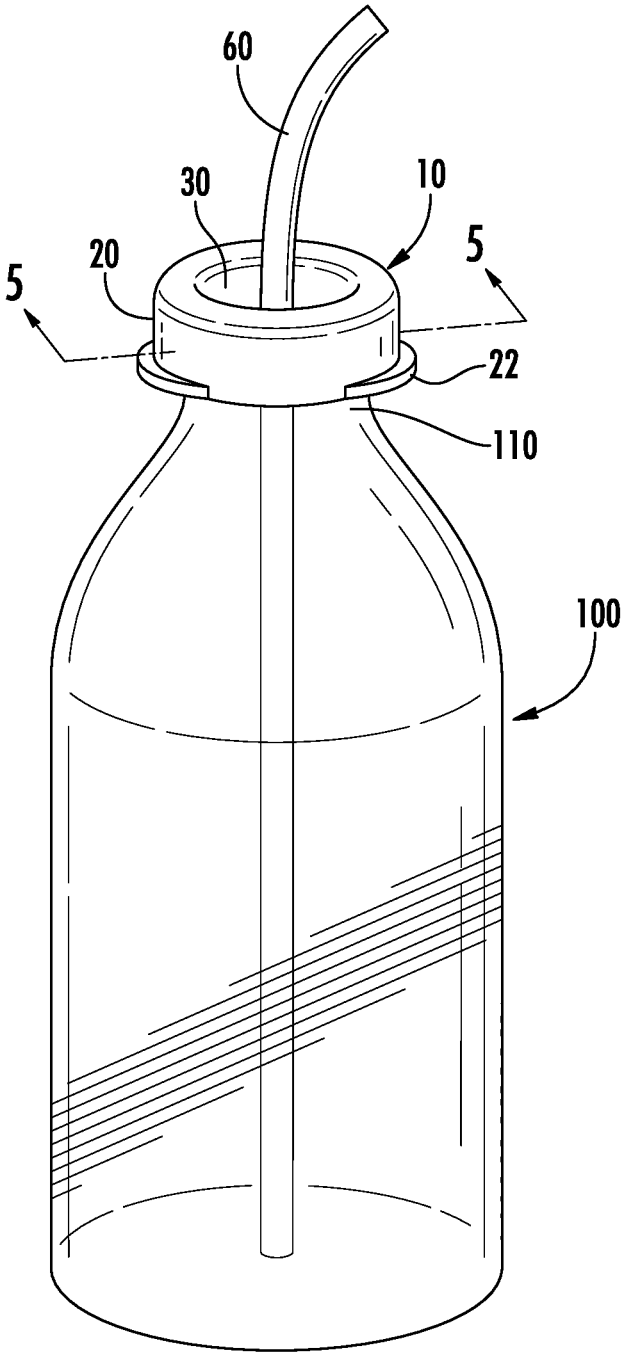
FIG. 4 is a perspective view of the cap of FIG. 1 disposed over a neck of a drink bottle with a straw inserted through an opening of the cap.
Figure 5:
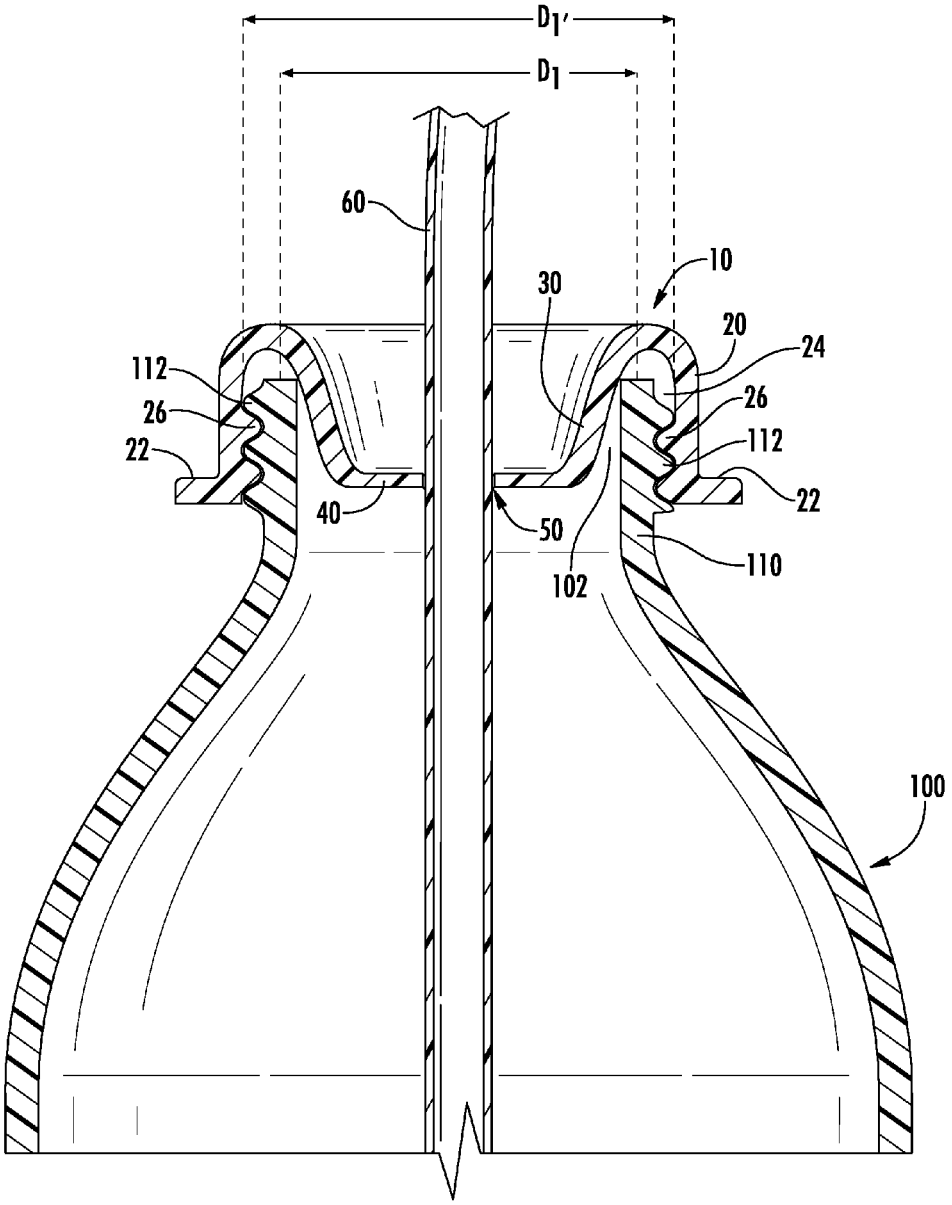
FIG. 5 is a cross-sectional view taken along section line 5-5 of FIG. 4.
Figure 6:
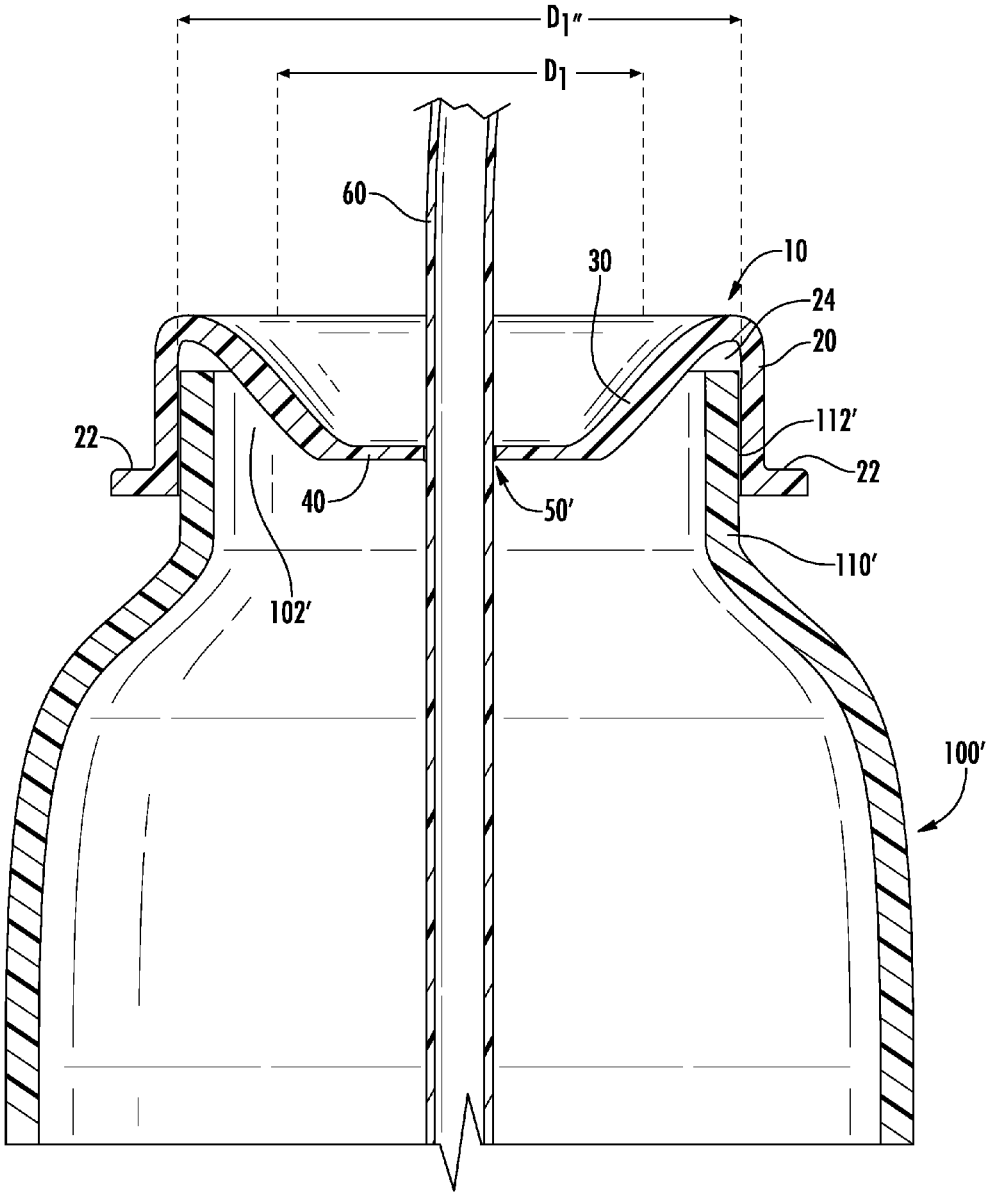
FIG. 6 is a cross-sectional view of the cap of FIG. 1 disposed over a neck of a large mouth drink bottle, the cap having another embodiment of an opening in accordance with the present disclosure.

With reference to FIGS. 4 and 5, the non-spill cap 10 is disposed over a neck 110 of a bottle 100 to seal a mouth 102 of the bottle 100. With particular reference to FIG. 5, outer wall 20 of the non-spill cap 10 is positioned around the neck 110 of the bottle 100 with the engagement features 26 of the outer wall 20 engaging an outer surface 112 of the neck 110 to prevent the non-spill cap 10 from inadvertently disengaging from the neck 110. The dimension $D_1$ of the outer wall 20 is sized such that the outer wall 20 has a diameter slightly less than an outer dimension of a neck 110 of a standard bottle 100 when in an unexpanded condition. In the unexpanded condition the initial dimension $D_1$ of the outer wall 20 is in a range of about 1.125 inches to about 1.75 inches (e.g., about 1.5 inches). When the outer wall 20 is positioned around the neck 110 of the bottle 100, the outer wall 20 is stretched or expanded to a larger dimension to surround the neck 110 of the bottle 100. In the expanded condition of the outer wall 20 an expanded dimension $D_{1'}$ may be in a range of about 1.25 inches to about 2 inches such that the outer wall 20 is capable of surround necks of bottles having a variety of dimensions.

Continuing to refer to FIG. 5, when the outer wall 20 surrounds the neck 110 of the bottle 100, the neck 110 is positioned within the gap 24 defined between the outer wall 20 and the inner wall 30 of the non-spill cap 10. When the neck 110 of the bottle 100 has a dimension substantially equal to the unexpanded dimension $D_1$ of the outer wall 20, the inner wall 30 is substantially undeformed such that the recessed disk 40 is substantially parallel with the bottom of the outer wall 20.

With reference to FIG. 6, the non-spill cap 10 is disposed over a neck 110' of a large mouth bottle 100' having a mouth 102' significantly larger than the mouth 102 of the bottle 100 detailed above. The outer surface 112' of the neck 110' is smooth such that the outer wall 20 of the non-spill cap 10 forms a seal with the outer surface 112' of the neck 110'. In the expanded condition when the non-spill cap 10 is disposed over the neck 110' of the bottle 100', the non-spill cap 10 has an expanded dimension $D_{1''}$ significantly greater (e.g., about 2 inches) than the initial dimension $D_1$ of the outer wall 20. In such an expanded condition, the inner wall 30 is deformed such that the recessed disk 40 is positioned in a plane above the bottom of the outer wall 30. The deformation of the inner wall 30 to accommodate necks of bottles having different dimensions allows the recessed disk 40 to remain substantially undeformed until the insertion of the drinking element 60. The engagement features 26 of the outer wall 20 may engage neck 110' of the bottle 100' to form a seal.

Continuing to refer to FIG. 6, the recessed disk 40 defines a circular opening 50' that has a dimension smaller than a traditional drinking implement 60 (e.g., a drinking straw). When the drinking implement 60 is inserted through the circular opening 50', the circular opening 50' stretches about an outer surface of the drinking implement 60 to form a seal with the outer surface.

Referring back to FIGS. 4 and 5, a method for drinking from a bottle is described in accordance with the present disclosure. Initially, a user selects a bottle 100 having a cover (not shown) disposed over a neck 110 of the bottle 100 to seal a mouth of the bottle. The cover is then removed to open the mouth of the bottle 100.

With the cover removed, a non-spill cap 10 is disposed over the neck 110 of the bottle 100 to reseal mouth of the bottle 100. To dispose the non-spill cap 10 over the neck 110 of the bottle 100, a disk 40 of the non-spill cap 10 is positioned within the mouth 102 of the bottle 100. As the disk 40 is positioned within the mouth 102 of the bottle 100, one side of the outer wall 20 is positioned on an outer surface 112 of the neck 110 of the bottle 100. The other side of the outer wall 20 is stretched to position the entire outer wall 20 around the outer surface 112 of the neck 110 of the bottle 100 such that the neck 110 of the bottle 100 is disposed within the a gap defined between the outer wall 20 and an inner wall 30 of the non-spill cap 10. As the outer wall 20 stretches around the outer surface 112 of the neck 110, engagement features 26 extending from the outer wall 20 form a seal with the outer surface 112 of the neck 110. The outer surface 112 of the neck 110 may include outwardly extending engagement features (e.g., threads, one or more annular rings, or a lip, etc) that are engaged by the engagement features 26 of the outer wall 20.

With the outer wall 20 forming a seal with the outer surface 112 of the neck 110, a drinking implement 60 is inserted through an opening 50 defined in a disk 40 of the non-spill cap 10. Walls defining the opening 50 engage an outer surface of the drinking implement to form a seal. The drinking implement 60 may deform the opening 50 as the drinking implement 60 is inserted through the opening 50. When the drinking implement 60 is inserted through the opening 50, the drinking implement 60 may be used to consume the contents of the bottle 100.

A method of manufacturing the non-spill cap 10 in accordance with the present disclosure includes injecting a suitable material into a mold and removing the finished non-spill cap 10 from the mold.

It will be appreciated that the non-spill cap 10, as detailed above, is constructed of a non-toxic food safe resilient material that is flexible or stretchable in a plurality of directions. For example, the non-spill cap may be made from a non-toxic food safe silicone polymer such as Maxelast® provided by POLYMAX under the product number P3816-1.

The non-spill cap 10 may have an outer diameter in a range of about 1.25 inches to about 2 inches (e.g., 1.5 inches). The recessed disk 40 of the non-spill cap 10 may have a diameter in a range of about 0.5 inches to about 1 inches (e.g., about 0.875 inches). It is also envisioned that each of the slits 52, 54 defining the opening 50 may be defined by vertical sidewalls spaced apart in a range of about 0.01 inches to about 0.02 inches (e.g., about 0.015 inches). In embodiments where opening 50' is a circular opening, the opening 50' may have a diameter in a range of about 0.02 inches to about 0.0625 inches (e.g., about 0.03125 inches).

While several embodiments of the disclosure have been shown in the drawings, it is not intended that the disclosure be limited thereto, as it is intended that the disclosure be as broad in scope as the art will allow and that the specification be read likewise. Any combination of the above embodiments is also envisioned and is within the scope of the appended claims. Therefore, the above description should not be construed as limiting, but merely as exemplifications of particular embodiments. Those skilled in the art will envision other modifications within the scope of the claims appended hereto.

What is claimed:

1. A universal non-spill cap comprising:

an outer wall having a bottom end and a top end;

an inner wall extending from the top end of the outer wall, the inner wall having a first end secured to the top end of the outer wall and a second end positioned along or above a same plane as the bottom end of the outer wall to define a gap between the inner wall and the outer wall, the gap sized and dimensioned to receive a neck of a bottle such that the outer wall forms a seal with the neck; and a disk supported by the second end of the inner wall, the disk defining an opening that is configured to receive and form a seal about a drinking implement inserted therethrough.

2. The non-spill cap according to claim 1, wherein the outer wall includes engagement features that extend towards the inner wall, the engagement features configured to engage an outer surface of the neck of the bottle to secure the non-spill cap to the neck of the bottle.

3. The non-spill cap according to claim 2, wherein the engagement features are threads.

4. The non-spill cap according to claim 2, wherein the engagement features are annular rings.

5. The non-spill cap according to claim 1, wherein the opening is defined at the center of the disk.

6. The non-spill cap according to claim 1, wherein the opening is a circular opening.

7. A universal non-spill cap comprising:

an outer wall having a bottom end and a top end;

an inner wall extending from the top end of the outer wall, the inner wall defining a gap with the outer wall that is configured to receive a neck of a container such that the outer wall forms a seal with the neck; and a disk supported by a lowermost end of the inner wall, the disk defining an opening that is configured to receive and form a seal about a drinking implement inserted therethrough, wherein the opening includes a first slit and a second slit that intersect to form a cross.

8. The non-spill cap according to claim 7, wherein the opening is configured to seal a mouth of a bottle.

9. A universal non-spill cap comprising:

an outer wall having a bottom end and a top end;

an inner wall extending from the top end of the outer wall, the inner wall defining a gap with the outer wall that is configured to receive a neck of a bottle such that the outer wall forms a seal with the neck; and a disk supported by the inner wall recessed below a plane defined by the top end of the outer wall, the disk defining an opening that is configured to receive and form a seal about a drinking implement inserted therethrough.

10. The non-spill cap according to claim 9, wherein the opening includes a first slit and a second slit that intersect to form a cross.

11. The non-spill cap according to claim 9, wherein the opening is defined at the center of the disk.

12. The non-spill cap according to claim 9, wherein the outer wall include a release flange that extends outwardly from a bottom of the outer wall.

13. The non-spill cap according to claim 12, wherein the release flange forms an elliptical plane in a plane coincident with the bottom end of the outer wall.

14. The non-spill cap according to claim 9, wherein the opening is configured to seal a mouth of a bottle.

15. The non-spill cap according to claim 9, wherein the opening is a circular opening.

* * * * *